US009447677B2

(12) United States Patent
Fielder et al.

(10) Patent No.: US 9,447,677 B2
(45) Date of Patent: Sep. 20, 2016

(54) METHODS AND APPARATUS FOR SENSING IN WELLBORES

(71) Applicant: ESP COMPLETION TECHNOLOGIES L.L.C., Missouri City, TX (US)

(72) Inventors: Lance I. Fielder, Sugar Land, TX (US); Robert P. Fielder, III, Houston, TX (US)

(73) Assignee: ESP COMPLETION TECHNOLOGIES L.L.C., Missouri City, TX (US)

( * ) Notice: Subject to any disclaimer, the term of this patent is extended or adjusted under 35 U.S.C. 154(b) by 282 days.

(21) Appl. No.: 14/090,413

(22) Filed: Nov. 26, 2013

(65) Prior Publication Data

US 2014/0158347 A1 Jun. 12, 2014

Related U.S. Application Data

(60) Provisional application No. 61/730,420, filed on Nov. 27, 2012.

(51) Int. Cl.

| | |
|---|---|
| ***E21B 47/01*** | (2012.01) |
| ***E21B 47/00*** | (2012.01) |
| ***E21B 43/12*** | (2006.01) |
| ***F04B 47/02*** | (2006.01) |
| ***F04B 49/06*** | (2006.01) |
| *E21B 47/14* | (2006.01) |

(52) U.S. Cl.

CPC ..... *E21B 47/0007* (2013.01); *E21B 43/121* (2013.01); *E21B 47/0008* (2013.01); *F04B 47/02* (2013.01); *F04B 47/026* (2013.01); *F04B 49/06* (2013.01); *E21B 47/14* (2013.01)

(58) Field of Classification Search

CPC ..... E21B 2043/125; E21B 43/127; E21B 47/007; E21B 47/0008; E21B 47/01

See application file for complete search history.

(56) References Cited

U.S. PATENT DOCUMENTS 4,125,163 A * 11/1978 Fitzpatrick ..... G05D 9/12 166/250.03
4,741,208 A * 5/1988 Vandevier ..... E21B 17/003 166/66

(Continued)

FOREIGN PATENT DOCUMENTS

CA 2278827 * 1/2001 ..... E21B 17/00

OTHER PUBLICATIONS

Canadian Office Action dated Apr. 1, 2015, for Canadian Patent Application No. 2,834,480.

(Continued)

*Primary Examiner* — Cathleen Hutchins
(74) *Attorney, Agent, or Firm* — Patterson & Sheridan, L.L.P.

(57) ABSTRACT

Methods and apparatus for sensing wellbore conditions in artificial lift wells using low profile sensors that are installed on down hole production equipment that makes them easier to install and retrieve. In one embodiment, low profile sensors are installed on a rod string making their insertion and removal much easier than it would be if they were mounted on production tubing. The sensors can be attached directly to the rod string or can be attached to a cable that is attached to the rod string. The sensors can transmit their data electrically through the cable or through the rod string. Alternatively, the sensors can transmit their data acoustically through the rod string.

17 Claims, 8 Drawing Sheets

(56) References Cited

U.S. PATENT DOCUMENTS

| | | | | |
|---|---|---|---|---|
| 4,968,934 | A | 11/1990 | Robinet et al. | |
| 2002/0007952 | A1* | 1/2002 | Vann | E21B 43/126 166/369 |
| 2004/0251048 | A1* | 12/2004 | Kurkoski | E21B 47/01 175/41 |
| 2005/0000689 | A1* | 1/2005 | Peleanu | E21B 17/00 166/279 |
| 2010/0212396 | A1 | 8/2010 | Zenisek | |

OTHER PUBLICATIONS

EPO Extended European Search Report dated Nov. 27, 2014, for European Patent Application No. 13194628.7.
Schlumberger—"Phoenix Select CTS Monitoring Tools" brochure, 2 pages, date unknown.
Sercel-GRC Corp.—"Fortress PCP-4000" brochure, 2 pages, date unknown.
Zenith Oilfield Technology Ltd—"C-Series Artificial Lift Monitoring Systems" brochure, Apr. 2008, 6 pages.

* cited by examiner

METHODS AND APPARATUS FOR SENSING IN WELLBORES

RELATED APPLICATIONS

This application claims the benefit under 35 U.S.C. 119(e) of U.S. Provisional Application Ser. No. 61/730,420, entitled "METHODS AND APPARATUS FOR SENSING IN WELLBORES" and filed on Nov. 27, 2012, the entire contents of which are incorporated by reference.

BACKGROUND OF THE INVENTION

1. Field of the Invention

Embodiments of the present invention generally relate to sensors for monitoring production fluid characteristics in an artificial lift well. More particularly, embodiments relate to a low profile sensor installable on a rotating or recipcocating string in a well rather than on a tubing string.

2. Description of the Related Art

Artificial lift wells depend on pumps or the like to move hydrocarbons, water, or other liquids in a wellbore to the surface. Typically, down hole pumps are used to pump the liquid(s) to the surface. For example, an electric submersible pump (ESP) can be lowered into the wellbore to a depth at which the liquid (e.g., oil) collects. The pump can be powered from the surface by a power conductor (e.g., a conductor cable) that runs to an electric motor located adjacent the pump. As the pump operates, the fluid is urged upwards in a string of production tubing toward the surface where it is collected. Conditions around the pump, like temperature and pressure, can be monitored during production. In wells using ESPs, sensors detecting temperature, pressure, and the like can be mounted on or proximate to the pump located at a lower end of production tubing. Also, the power conductor powering the pump can also provide power to the sensors and can provide a signal path for information from the sensors. ESPs are routinely pulled from wells for maintenance and replacement. The sensors which are mounted on, adjacent to, or proximate to the ESP are also returned to the surface when the ESPs are pulled, providing an opportunity to also inspect, maintain, and/or replace the sensors.

In other applications in which down hole ESPs are not used, placing, powering, and replacing down hole sensors can be more difficult. For example, rod pumps (e.g., progressive cavity pumps) use a rod that extends from the surface to a rotor located down hole in the well. The rod can be rotated from the surface to turn the rotor in a stator down hole to pump the liquids to the surface. The rod pump does not have a down hole source of power for a sensor and the pump itself is smaller than an ESP, making the placement of a sensor difficult. Currently, in applications in which down hole pumps are not used, sensors are placed on production tubing that surrounds the rod string. As a result, replacement of the sensor requires the production tubing to be pulled.

In other examples in which down hole ESPs are not used, a reciprocating pump can include a plunger and valve pump assembly that can be positioned down hole and a beam and crank assembly at the well surface that can create reciprocating motion in a sucker-rod string that connects to the down hole plunger and valve pump assembly. The pump contains a plunger and valve assembly to convert the reciprocating motion of the rod string to vertical fluid movement. As with rod pumps, the reciprocating pump does not have a down hole source of power for a sensor. Again, currently, sensors are placed on production tubing and therefore require the production tubing string to be removed to gain access to the sensor (e.g., to perform maintenance on the sensor or to replace the sensor).

When operating progressive cavity pumps and reciprocating rod pumps, the rods can be pulled to inspect, repair, or replace a damaged pump or rotor. The ability to deploy the sensor on the rods (rather than on surrounding tubing) could prevent a costly heavy workover to remove the tubing. The ability to deploy the sensor on the rods can also provide an inexpensive means of temporary deployment of the sensor for well testing or flow optimization.

What is needed is a more effective and efficient way to monitor wellbore conditions in the area of a down hole pump and a simpler way to remove sensors in the event they need replacement.

SUMMARY OF THE INVENTION

The present invention generally provides methods and apparatus for sensing wellbore conditions in artificial lift wells using low profile sensors that are installed on down hole equipment that makes them easier to install and retrieve.

According to one method, a low profile sensor can be installed on a rod string and then the rod string can be inserted into a well. While the rod string is being actuated to pump the well, the sensor can periodically take readings in the well. For example, the sensor can be taking pressure and temperature readings in the well. The sensor can transmit the readings up to the well surface.

According to certain embodiments, an apparatus can include a low profile sensor that fits in an annulus between a rod string and one of production tubing and casing. The sensor can include a transmitter that transmits the sensed data to the well surface. The sensor can be attached to a cable that is attached to the rod string or the sensor can be attached directly to the rod string.

BRIEF DESCRIPTION OF THE DRAWINGS

So that the manner in which the features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

In various embodiments, a low-profile sensor can be installed on a rod string to measure parameters in a well bore near a pump being operated by the rod string. The sensors enable a well operator to monitor the health of the pump and/or the production capability of the well, for example.

Figure 1:
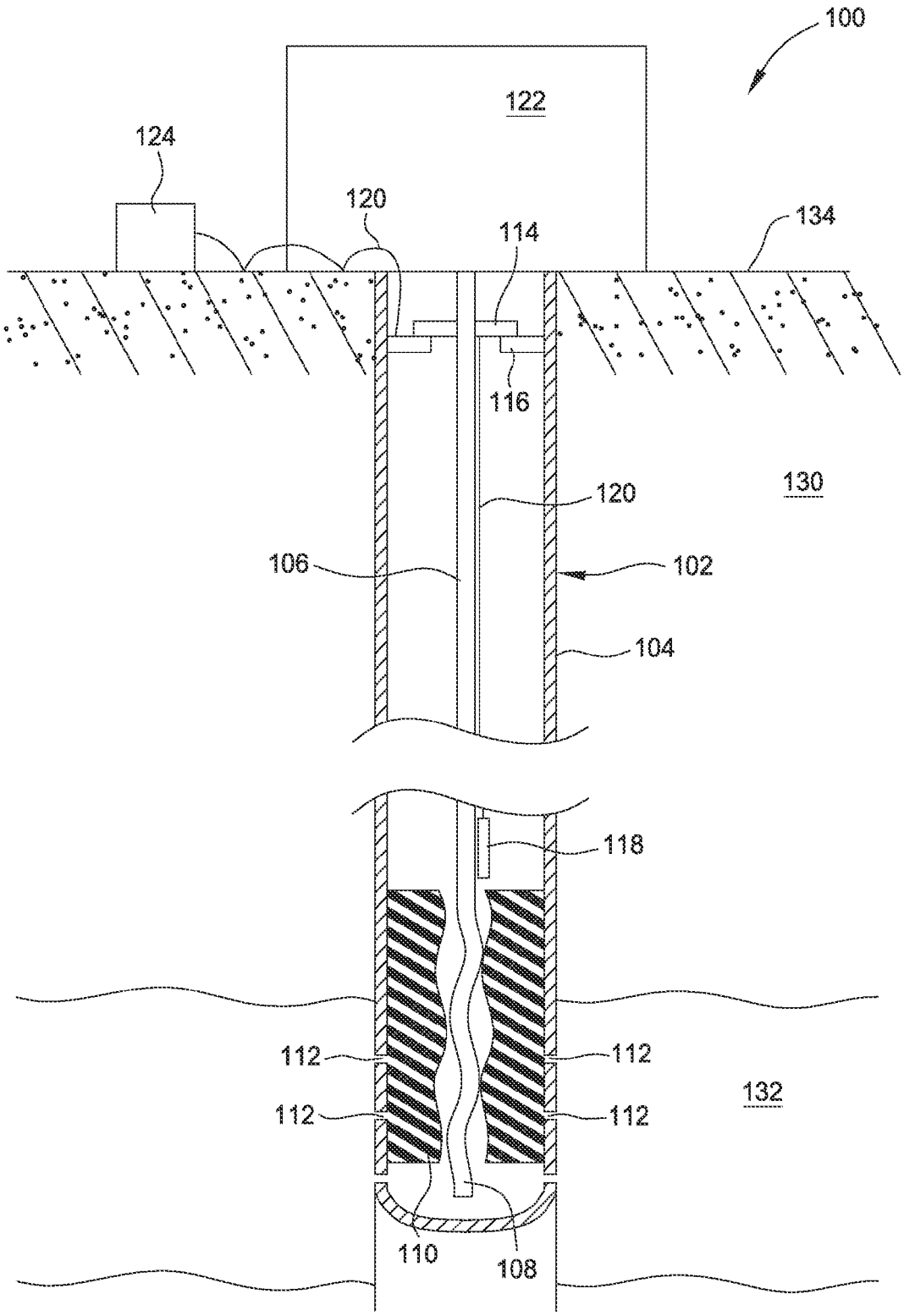
FIG. 1 is a partial cross-sectional view of a well with a progressive cavity pump; wherein an embodiment of a sensor is attached to a rotating rod string.

Referring to FIG. 1, in one embodiment, a low profile sensor 118 can be installed on a rotating pumping rod string 106 that operates a progressive cavity ("PC") pump 108, 110 at a lower end of the pumping rod string 106. A progressive cavity pump, including a rotor 108 and a stator 110, is a type of positive displacement pump and is also known as a progressing cavity pump, eccentric screw pump or cavity pump. The PC pump transfers fluid by means of the progress, through the pump, of a sequence of small, fixed shape, discrete cavities, as its rotor is turned. This progress of fixed-shape cavities leads to the volumetric flow rate being proportional to the rotation rate (bidirectionally) and to low levels of shearing being applied to the pumped fluid. Hence, these pumps have application in fluid metering and pumping of viscous or shear-sensitive materials. The cavities taper down toward their ends and overlap with their neighbours, so that, in general, no flow pulsing is caused by the arrival of cavities at the outlet, other than that caused by compression of the fluid or pump components.

The pumping rod string 106 can be positioned in a well 102 in the earth 130 inside of casing 104. In some embodiments, the well 102 can also include one or more production tubing strings between the pumping rod string 106 and the casing 104. Perforations 112 in the casing 104 (and any production tubing strings) enable the oil, water, and/or natural gas to enter into the casing 104 (and any production tubing strings). The pumping rod string 106 can be positioned in the well 102 such that the rotor 108 and stator 110 are positioned near the perforations 112 at the oil, water, and/or natural gas deposit 132. Then, the pumping rod string 106 can be rotated such that the rotor 108 of the PC pump is rotated in the stator 110. The resulting rotation displaces the water, oil, and/or natural gas upwards toward the surface 134 of the well 102.

Figure 3C:
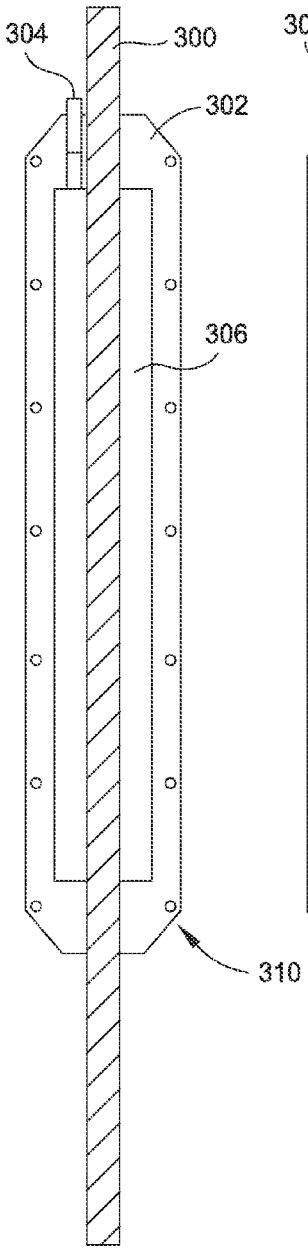
FIGS. 3A-3C illustrate an embodiment of a sensor attached to a cable.
Figure 3B:
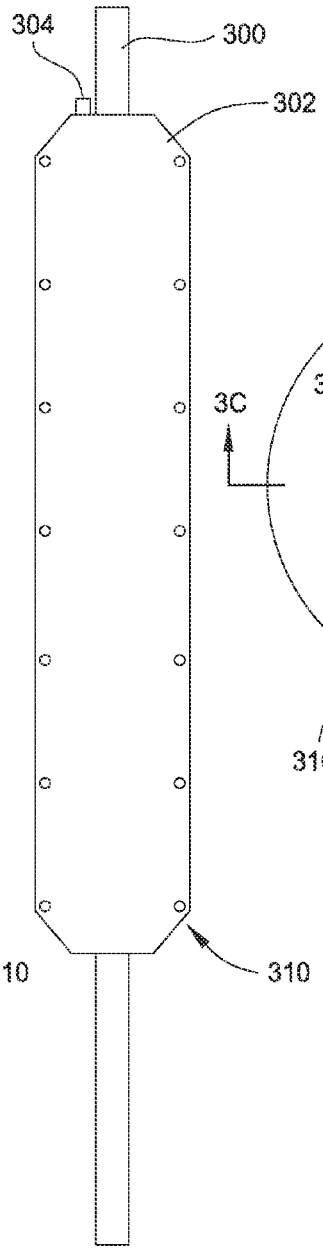

In the embodiment shown in FIG. 1, the rotating pumping rod string 106 includes a sensor cable 120 extending from the sensor 118 towards the surface 134 of the well 102. As shown in FIGS. 3B and 3C, in various embodiments, the cable 120 can pass through the sensor 118. In such embodiments, an end of the cable 120 below the sensor 118 can be attached to the pumping rod string 106. The cable 120 (e.g., tubing encapsulated conductor (TEC) cable) can provide power to the sensor and can and transmit information from the sensor 118 to a receiver 124 at the surface 134 of the well 102. The cable 120 and sensor 118 can rotate with the pumping rod string 106. The well 102 can include a coupling 114, 116 that permits electrical and data communication between the sensor cable 120 and sensor 118 rotating with the rod string and a stationary housing there around (e.g., casing 104). For example, the coupling can include a rotating disk 114 that is connected to the pumping rod sting 106 and is made of copper, brass, or another conductive material. The pumping rod string 106 can be electrically coupled to the rotating disk 114 such that information from the sensor 118 that is transmitted via the cable 120 and the pumping rod string 106 can pass onto the rotating disk 114. Alternatively, the cable 120 can be directly attached and electrically coupled to the rotating disk 114. The coupling can also include a stationary disk 116 that can be mounted to a stationary structure, such as the casing 104, for example. The stationary disk 116 can also be made of copper, brass, or another conductive material. When the rotating pumping rod string 106 is placed in the well 102, the rotating disk 114 can be in sliding contact with the stationary disk 116. As a result, an electrical connection can be formed between the rotating disk 114 and the stationary disk 116 such that electrical signals can be passed from the sensor 118 to the stationary disk 116 via the rotating disk 114 and power can be transmitted from the stationary disk 116 to the sensor 118. At the surface, another segment of cable 120 can carry sensor signals from the stationary disk 116 to a receiver 124. As will be described in greater detail below, in alternative embodiments, the sensor 118 can be arranged around and attached to the rotating rod 106, eliminating the cable 120. In such embodiments, if the rod string 106 includes a conductive material, sensor signals can be transmitted from the sensor 118 through the pumping rod string 106 to the rotating disk 114 and onto the stationary disk 116.

In alternative embodiments, an electrical connection between the rotating pumping rod string 106 and a stationary housing (e.g., the casing 104) can be accomplished by fixing a first outer ring electrode to the casing 104 and a first inner ring electrode to the rotating pumping rod string 106 for rotation therewith. An annular gap can be formed between the first outer ring electrode and the first inner ring electrode. The first outer ring electrode and the first inner ring electrode form a first connector gap in fluid communication with the annular gap. In an additional optional step, a second outer ring electrode can be fixed to the casing 104 and a second inner ring electrode to the pumping rod string 106 for rotation therewith. The second outer ring electrode and the second inner ring electrode can form a second connector gap in fluid communication with the annular gap. A fluid may be supplied in the annular gaps to complete an electrical connection between the rotating inner ring electrode(s) and the stationary outer ring electrode(s). An object of the arrangement is to provide an electrical connection between a rotating structure and another structure that may be stationary or rotating in a down hole tool. Such connections are well known in the art and one further example is shown in U.S. Pat. No. 8,162,044 which is incorporated herein by reference in its entirety.

In the event the progressive cavity pump needs to be inspected, repaired, or replaced, the pumping rod string 106 can be pulled out of the well 102. The sensor 118 (and cable 120, when used) will also be pulled out of the well 102 as a result, providing an opportunity to inexpensively inspect, repair, and/or replace the sensor 118 too.

Figure 2:
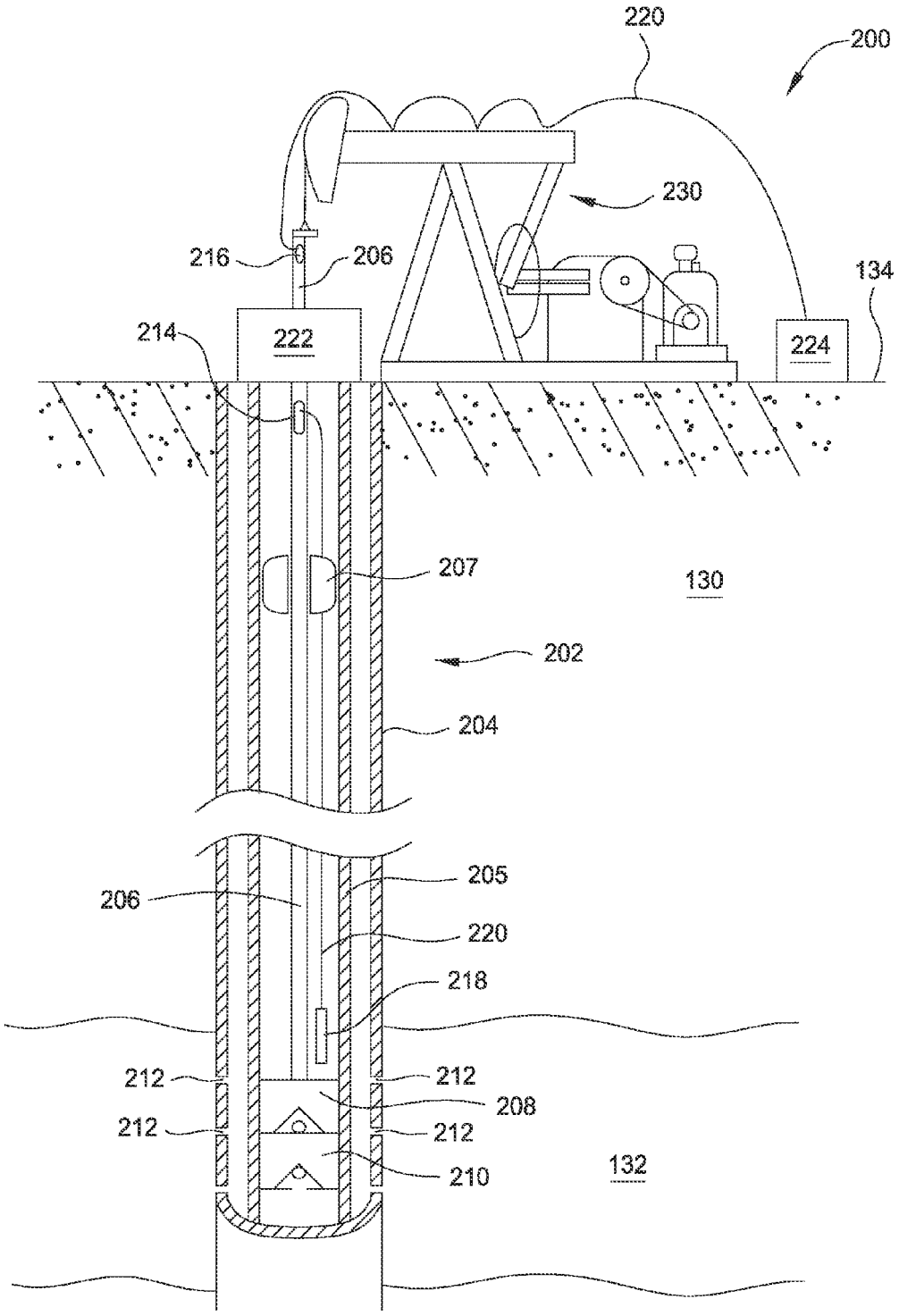
FIG. 2 is a partial cross-sectional view of a well with a reciprocating rod pump, wherein an embodiment of a sensor is attached to a reciprocating rod string.

Referring now to FIG. 2, in another embodiment, a low profile sensor 218 can be installed on a reciprocating pumping rod string 206 in a beam pump 208, 210. The reciprocating pumping rod string 206 can be driven up and down in a well 202 by a pump jack 230. In this embodiment, the well 202 includes casing 204, production tubing 205, and the reciprocating pumping rod string 206. Oil, water, and/or natural gas from an underground reservoir 132 can pass through the casing 204 and/or production tubing 205 through perforations 212. A series of check valves 208 and 210, in combination with a plunger, lift the oil, water, and/or natural gas from the pump towards the surface 134. One or more rod guides 207 can be arranged on the reciprocating pumping rod string 206 to align the reciprocating rod 206 within the well bore 202. Similarly to FIG. 1, a low profile sensor 218 can be attached to a cable 220 (e.g., TEC) and reciprocate up and down with the reciprocating pumping rod string 206. The cable 220 can extend up toward the surface 134. The cable 220 can pass through slots or apertures in the rod guides. Often, in a pump jack 230 arrangement, a reciprocating rod, such as reciprocating pumping rod string 206 will pass through a seal at the well head 222. A top portion of the reciprocating pumping rod string 206 can be hollow and can include two apertures 214 and 216. The lower aperture 214 can be positioned in the well 202 below the seal and the upper aperture 216 can be positioned above the well head 222 and above the seal. As shown, the cable 220 can pass into the hollow portion of the reciprocating pumping rod string 206 through the lower aperture 214 and then exit out of the hollow portion through the upper aperture 216. Routing the cable 220 through the hollow portion of the pumping rod string 206 via apertures 214 and 216 can avoid problems caused by attempting to run the cable 220 through the seal in the well head 222. After passing out of the well head 222, the cable 220 can then lead to a receiver 224 where data from the sensor 218 can be collected.

As will be described in greater detail below, in certain embodiments, the sensor 218 can be attached directly to the reciprocating pumping rod string 206. For example, the sensor 218 can be clamped around the pumping rod string 206. If the reciprocating pumping rod string 206 includes a conductive material, then power can be transmitted to the sensor 218 via the pumping rod string 206 and signals can be transmitted from the sensor 218 via the pumping rod string 206. A cable can be attached to a top end of the reciprocating pumping rod string 206 to pass the signal from the pumping rod string 206 to the receiver 224.

In the event the reciprocating pump needs to be inspected, repaired, or replaced, the pumping rod string 106 can be pulled out of the well 202. The sensor 218 (and cable 220, when used) will also be pulled out of the well 202 as a result, providing an opportunity to inexpensively inspect, repair, and/or replace the sensor 218.

Figure 3A:
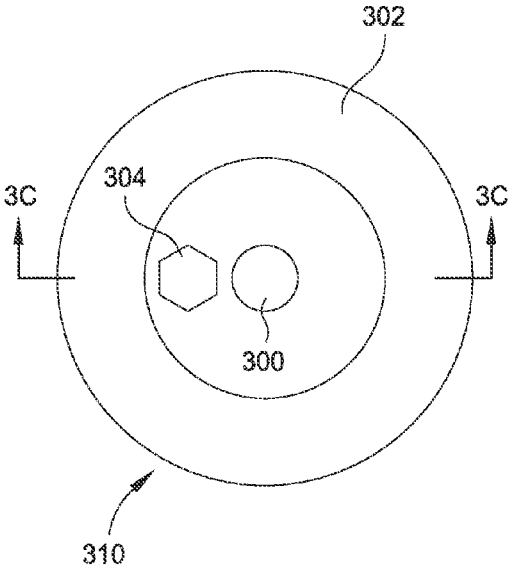

FIGS. 3A-3C illustrate an embodiment of a low profile sensor 310 attached to a cable 300. Referring to FIG. 3A, a top view of the sensor 310 and cable 300 shows that the sensor 310 can be coaxially arranged around the cable 300. In various embodiments, an outer diameter of the cable 300 can be three quarters of an inch and the outer diameter of the sensor 310 can be two inches, for example. FIG. 3B illustrates a side view of a half of the outer casing 302 of the sensor 310. The sensor 310 can include two casings 302 that clamp around the cable 300. The casings 302 can be held together by a series of screws 308, bolts, clips, adhesives, or the like. Referring now to FIG. 3C, a cross-sectional view of the sensor 310 shows an interior cavity 306 that can house the sensor components. For example, the interior cavity 306 can house a pressure sensor, a temperature sensor, memory for storing transducer readings, a data transmitter, a computer processor for recording transducer readings to memory and for transmitting readings from memory. At least some of the sensor components can include micro-electrical-mechanical systems (MEMS). In certain embodiments, the pressure sensor can include a low profile pressure sensor capable of measuring pressures between 0 and 3,000 pounds per square inch (psi) and that is capable of withstanding temperatures up to 125° C. In certain embodiments, the temperature sensor can include a resistive temperature detector capable of measuring temperatures between 0 and 125° C. In certain embodiments, a printed circuit board that enables signals from the pressure sensor and RTD to be processed and transmitted through the transmission conduit to the surface receiver (e.g., receiver 124 or 224). In certain embodiments, the interior cavity 306 of the sensor 310 can also include a power supply that can power the sensor components. For example, the power supply can comprise a battery (e.g., a lithium ion battery) and/or a capacitor. The casing 302 of the sensor 310 can include one or more ports 304 through which the sensor can detect aspects (e.g., temperature and pressure) of the liquids being pumped by the well.

Figure 4C:
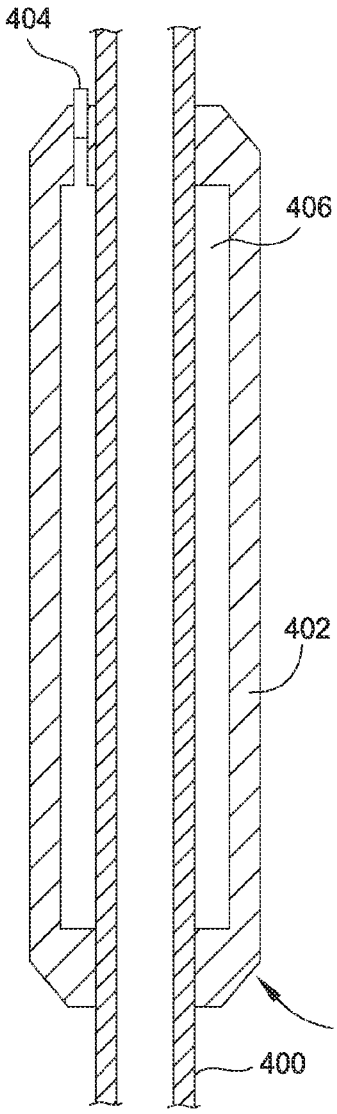
FIGS. 4A-4C illustrate an embodiment of a sensor attached to and surrounding a rod string.
Figure 4B:
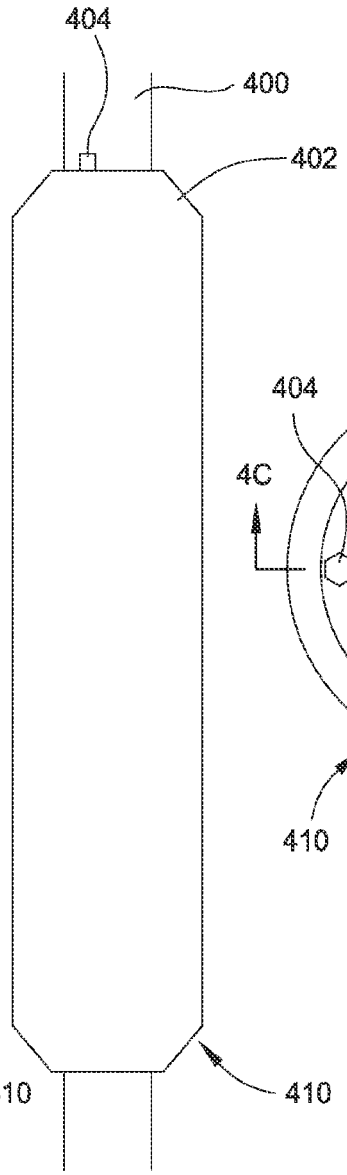
Figure 4A:
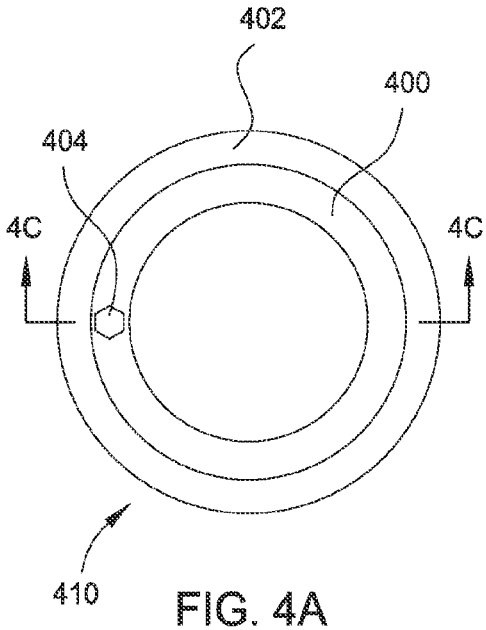

FIGS. 4A-4C illustrate an embodiment of a low profile sensor 410 attached to a rotating or reciprocating pumping rod string 400. The pumping rod string 400 is illustrated as being hollow, but it can also be solid. In various embodiments, an outer diameter of the pumping rod string 400 can be 2.38 inches and an outer diameter of the casing 402 can be 3.88 inches, for example. Referring to FIGS. 4B and 4C, the sensor 410 can include an interior cavity 406 that houses sensor components, such as a pressure transducer, a temperature transducer, memory for storing transducer readings, a data transmitter, a computer processor for recording transducer readings to memory and for transmitting readings from memory. The cavity 406 can also include a power supply, such as a battery or capacitor. The casing 402 of the sensor 410 can include one or more ports 404 through which the sensor can detect aspects (e.g., temperature and pressure) of the liquids being pumped by the well.

Referring to FIGS. 3A-3C and 4A-4C, the sensor components will, in certain embodiments, be positioned in the cavities 306 and 406 in the sensor casings 302 and 402, respectfully. The sensor components can be distributed between the two halves and the halves can then be filled Polycast RTV-793 high thermally conductive silicone with high dielectric strength and high tensile strength. In one example, the two halves can be molded to the tubing and cured for 24 hours before assembly and testing. In certain other embodiments, the sensor components can be positioned in a first half of the cavities 306 and 406 and a power supply can be positioned in the second half of the cavities 306 and 406.

The basic operation of down hole sensors, such as sensors 310 and 410, described above, and their components are well known. An example of such sensors includes the FORTRESS PCP-4000 down hole progressive pump sensor made by Sercel-GRC Corporation, the specifications of which are incorporated by reference in their entirety.

As described above, in certain embodiments, a cable, such as cable 300 can provide communication and power to the sensor 310. As also described above, in certain other embodiments, the sensor 310 can be powered by an on-board power supply (e.g., an on-board lithium battery) capable of powering the system for the normal life of the artificial lift well or at least for a period of time corresponding to a scheduled maintenance interval that requires the rod string and/or pump to be removed from the well. Incorporating an on-board power supply into the sensor can eliminate or minimize the amount of power that must be supplied to the sensor via a cable. As a result, a smaller-diameter cable that only has to carry sensor signals can be used. In certain other embodiments, an on-board power source in the sensor can operate in conjunction with a powered cable to provide power to the sensor. For example, a smaller-diameter cable can be connected to the sensor that only provides a fraction of the power demand required by the sensor when the sensor is actively recording and/or transmitting sensor readings. However, the power provided by the cable can be sufficient to charge the on-board power supply (e.g., a battery or capacitor) during periods between sensor readings. The on-board power supply, alone or in combination with the cable, can then power the sensor when the sensor is actively recording and/or transmitting sensor readings.

Figure 5A:
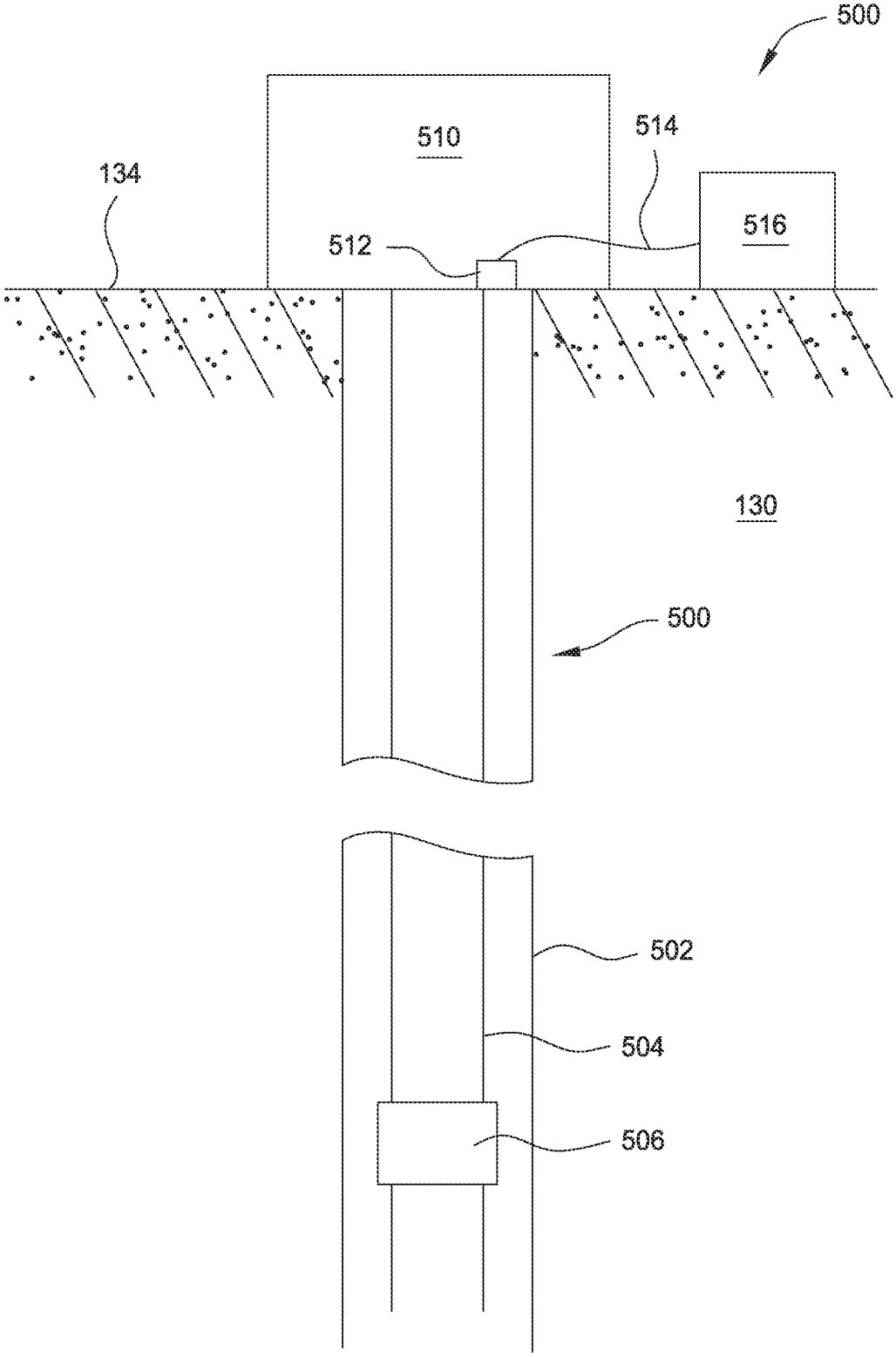
FIG. 5A is a partial cross-sectional view of a well with a rod string inserted therein, wherein an acoustic-transmitting sensor is attached to the rod string.

In other embodiments, a sensor system can communicate data to the surface using acoustic telemetry rather than electrical signals. Sending and receiving down hole data using telemetry is known in the art and an example of the technology is described in US Publication No. 2008/0030365, the contents of which are incorporated herein by reference in their entirety. Referring to FIG. 5A, a sensor 506 with an on-board power source can be attached to a pumping rod string 504 inside of production tubing (and/or casing) 502 in a well bore 500. The sensor 506 can include an acoustic transmitter (e.g., a piezoelectric transducer and/or speaker) that can emit acoustic signals. In certain embodiments, the acoustic transmitter can be coupled to the pumping rod string 504 such that it transmits the acoustic signal (i.e., the acoustic telemetry) into the pumping rod string 504. The acoustic signal then propagates along the pumping rod string 504 to a microphone 512 at the surface 134 of the well 500. The microphone 512 can then pass the received acoustic signal to a receiver 516 via a surface cable 514. The receiver 516 can log sensor readings. By transmitting the sensor data acoustically and powering the sensor with an on-board power supply, a cable (e.g., TEC cable) connecting the sensor to the surface can be eliminated, thereby reducing costs, increasing the ease of deploying sensors into wellbores, and increasing the reliability of data transmission (e.g., that can otherwise be interrupted by damage to the cable).

In certain instances, the sensor 506 may not have sufficient power to transmit an acoustic signal to the surface. In such instances, one or more repeaters can be arranged between the sensor 506 and the microphone 512 to boost the strength of the acoustic signal.

Figure 5B:
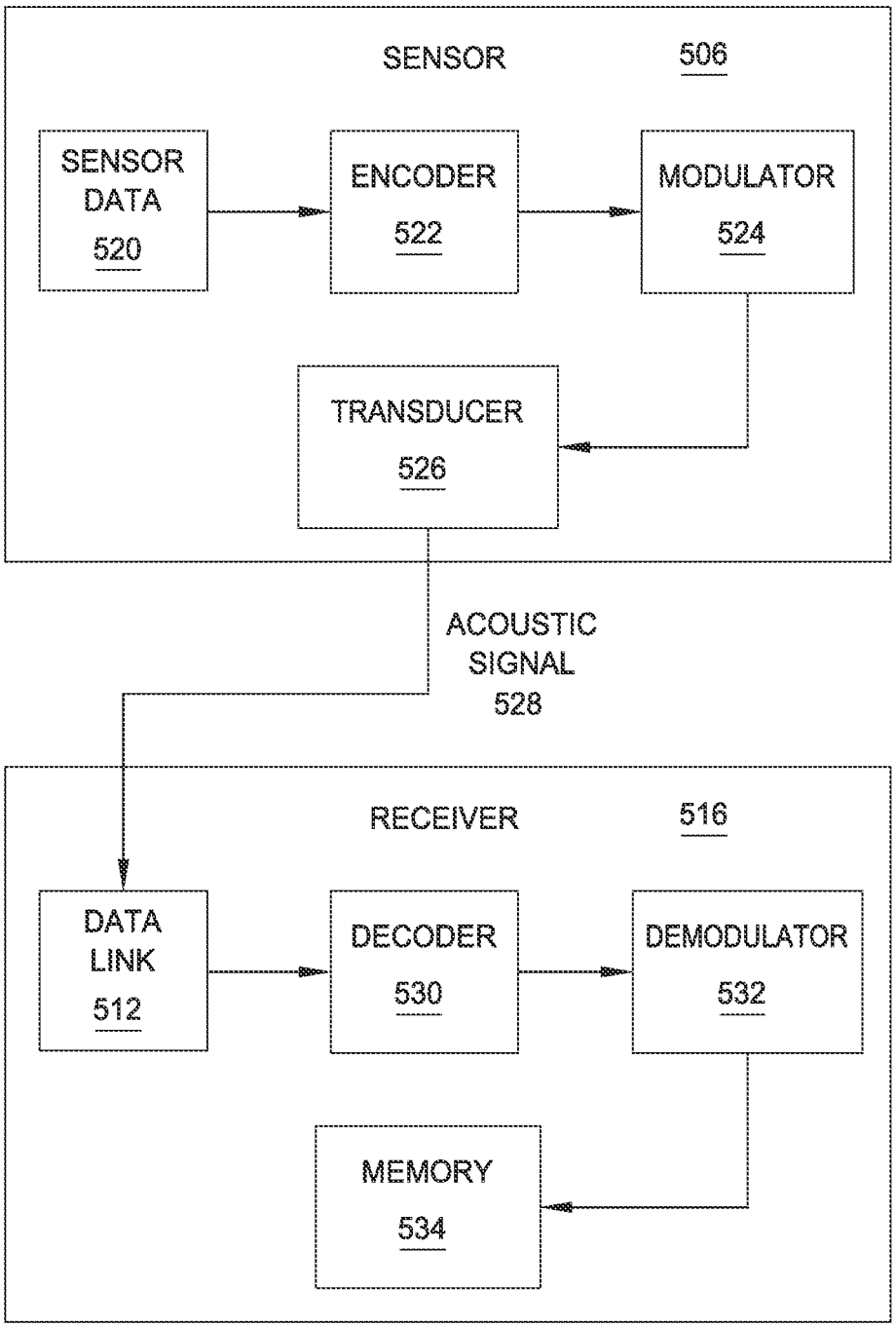
FIG. 5B is a block diagram of an embodiment of an acoustic-transmitting sensor and a receiver for receiving acoustically-transmitted signals.

Referring now to FIG. 5B, a block diagram illustrates an embodiment of modules, systems, components, and the like in the sensor 506, microphone 512, and receiver 516 that gather, transmit, interpret, and store acoustically-transmitted telemetry. The acoustic-transmitting sensor 506 can gather sensor data 520 and pass the data into an encoder 522. The encoder can translate the sensor data into a computer-readable format. For example, the encoder 522 can translate the sensor data 522 into a 16-bit binary format. The encoded data can then be sent to a modulator 524 that can generate a modulated waveform that can transmit the encoded data. For example, the modulated waveform can comprise a frequency modulated waveform wherein "zeros" of an encoded binary data packet can be represented by a first frequency and wherein "ones" of the encoded binary data packet can be represented by a second frequency. The modulator 524 can pass the modulated waveform to a transducer 526 that can transmit the modulated waveform as an acoustic signal 528 to the rod string, as described above. For example, the transducer 526 can transmit the modulated waveform onto a steel surface of the rod string 504 or tubing such that the modulated waveform can propagate along the rod string 504 or tubing to a data link (e.g., the microphone 512) at the surface 134 of the well 500. This means of transmission is most feasible when the data transmissions are limited to small packets of data, such as a batch of pressure and temperature readings.

After propagating along the pumping rod string, the acoustic signal 528 can reach a data link 512 (e.g., a microphone) coupled to the receiver 516. The data link 512 can transmit the acoustic signal 528 to a decoder that converts the acoustic signal 528 into an electrical modulated waveform signal. The electrical modulated waveform signal can then be passed to a demodulator, which can extract the signal information (e.g., the binary data packet) from the modulated waveform. The extracted signal information can then be stored in memory 534.

Figure 6:
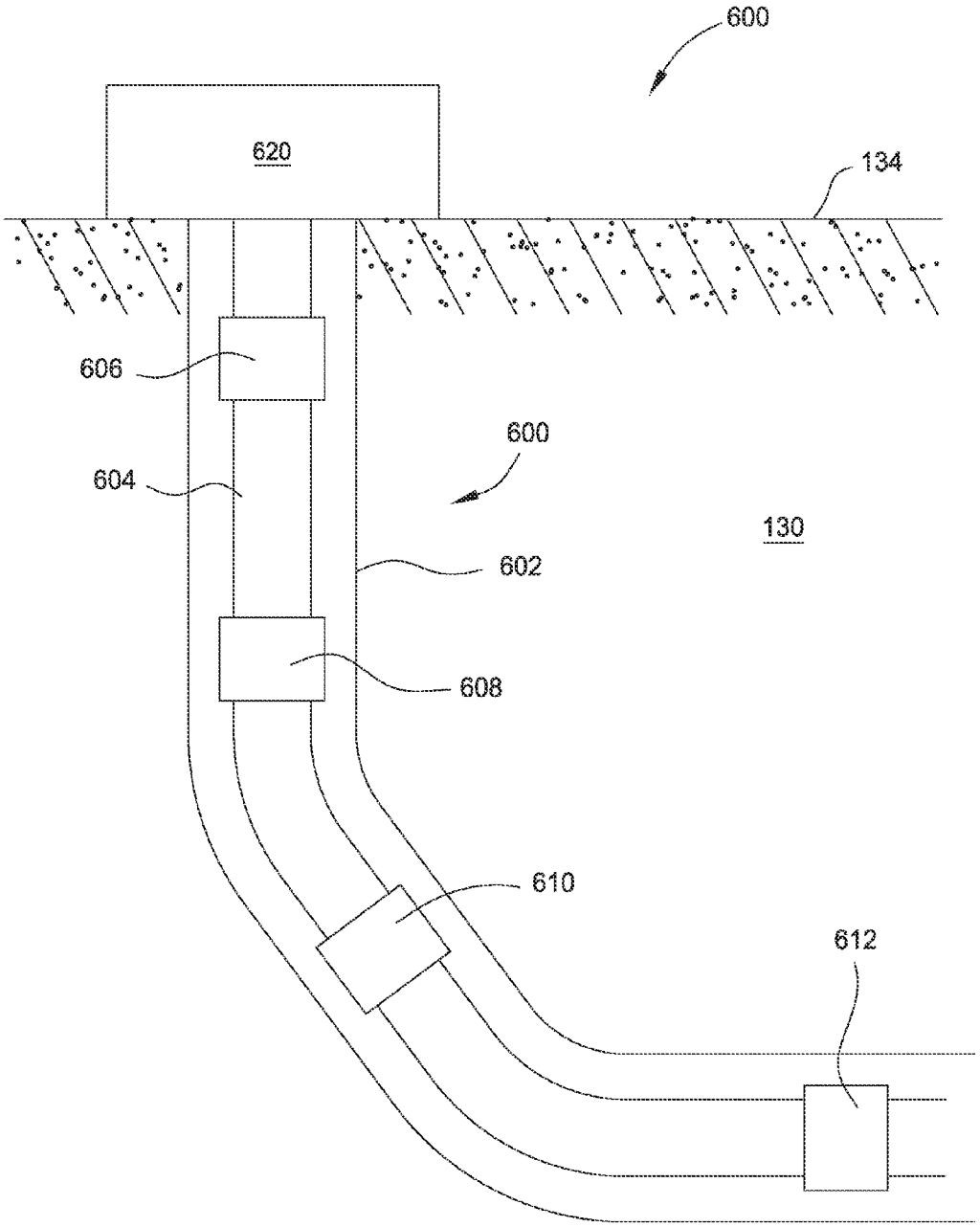
FIG. 6 is a partial cross-sectional view of a well with a rod string inserted there, wherein a plurality of sensors are attached to the rod string at different locations.

Referring now to FIG. 6, in certain embodiments, multiple sensors 606, 608, 610, and 612 can be deployed at intervals along a pumping rod string 604 in a well 600. FIG. 6 shows an embodiment in which four sensors are deployed at different locations along a pumping rod string in a well bore 602. For example, each sensor may be deployed to measure pressure and temperature at a different producing zone within a well (i.e., at different depths and/or locations at which oil, water, and/or natural gas may be found). In addition to measuring pressure and temperature data at its location in the well 600, in certain embodiments, the sensor 606 nearest the surface 134 can act as a host for remaining sensors 608, 610, and 612. The host sensor 606 can receive pressure and temperature data signals from the remaining sensors 608, 610, and 612 and re-transmit the data signals to a receiver at the well head 620. Furthermore, in certain embodiments, each sensor can re-transmit data from sensors beneath it to sensors above it. For example, sensor 610 can receive and re-transmit data from sensor 612. Similarly, sensor 608 can receive and re-transmit data from sensor 610 (which can include the data re-transmitted from sensor 612).

In certain embodiments, the sensors 606, 608, 610, and 612 can share a common cable or pumping rod string (e.g., TEC tubing) such that each sensor receives power from the cable or pumping rod string and also transmits data on the cable. In various other embodiments, the sensors 606, 608, 610, and 612 can transmit data acoustically along the pumping rod string 604, as described above. In either embodiment, the signals from different sensors can be distinguished from the signals of remaining sensors. For example, each sensor could transmit its signal at a different frequency, enabling a receiver at the wellhead 620 to distinguish each of the different sensor signals. As another example, different sensors can be configured to transmit data signals at different times. For example, sensor 606 can be configured to transmit its data at the top of each hour (e.g., 1:00 PM, 2:00 PM, etc.), sensor 608 can be configured to transmit its data at a quarter past each hour (e.g., 1:15 PM, 2:15, PM), sensor 610 can be configured to transmit its data at a half past each hour (e.g., 1:30 PM, 2:30 PM, etc.), and sensor 612 can be configured to transmit its data at a quarter before each hour (e.g., 1:45 PM, 2:45 PM, etc.). In such a configuration, the receiver at the well head 620 can identify the sensor associated with a particular signal based on the time the signal is received.

Figure 7:
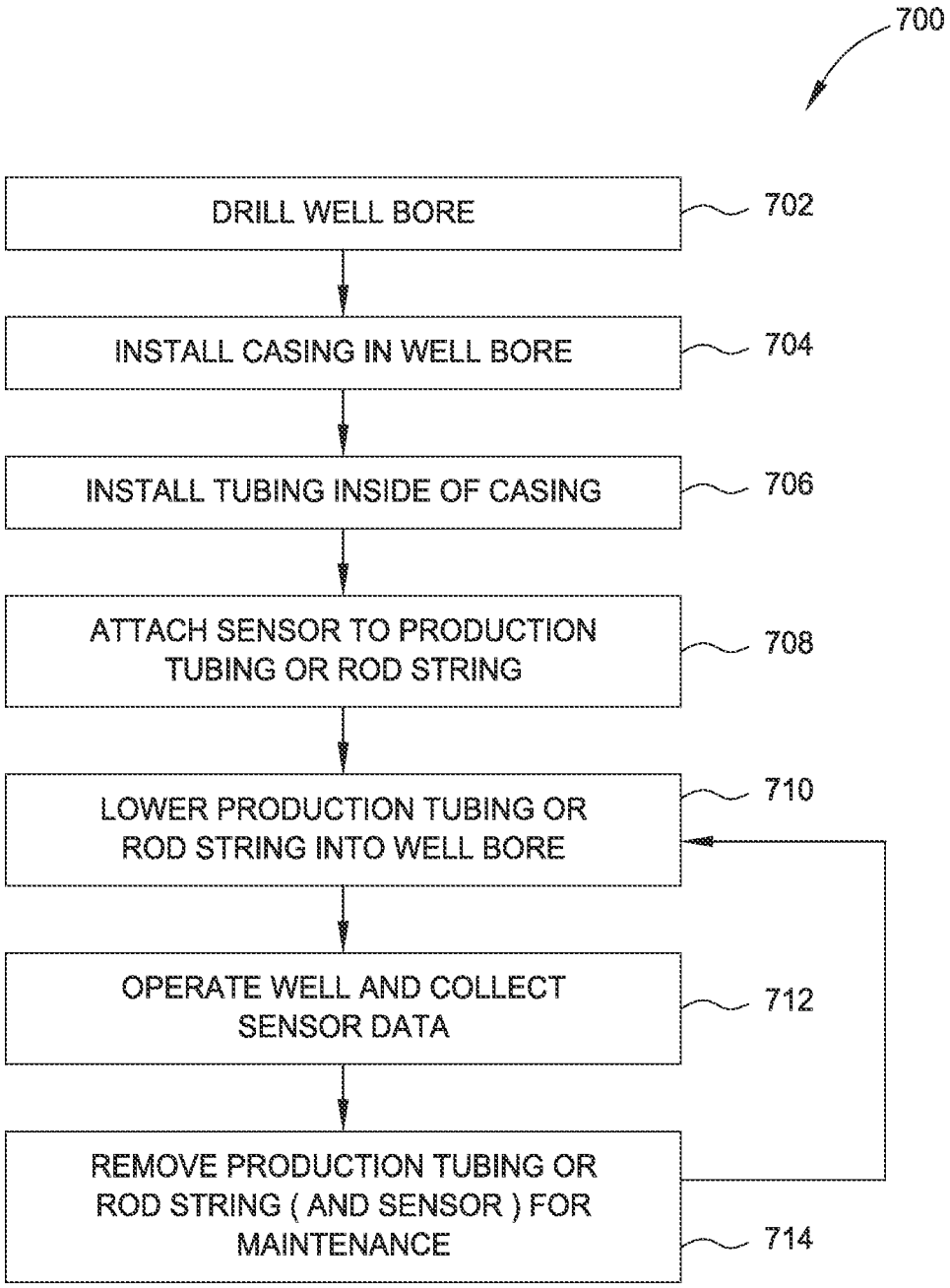
FIG. 7 is a flow chart that illustrates an embodiment of a method for operating a well using embodiments of the sensors described herein.

FIG. 7 illustrates a flow diagram of an embodiment of a method 700 for operating a well according to embodiments of the present invention. After a well bore has been drilled (block 702), a casing can be installed in the well bore (block 704). Optionally, production tubing can be installed within the casing (block 706). After the production tubing is installed, a well can be ready for production (e.g., pumping of oil, water, and/or natural gas from an underground deposit to the surface). A down hole sensor, such as any of sensors 118, 218, 310, 410, 506, or 606, 608, 610, and 612, described above, can be attached to a pumping rod string that drives a pump to pump the oil, water, and/or natural gas out of the well (block 708). For example, the pumping rod string can rotate to drive a rotor of a progressive cavity pump or can reciprocate to drive a plunger valve assembly pump. After the sensor(s) is (are) attached to the pumping rod string, the pumping rod string can be lowered into the well bore (block 710). After being lowered into the well bore, the pumping rod string can be operated (e.g., rotated or reciprocated) to operate the pump in the well (block 712). As the pumping rod string is operated, the sensor(s) can periodically transmit information about aspects of the well (e.g., pressure and temperature data) to a data receiver at the well surface (block 712). Occasionally, the pumping rod string may need to be removed from the well for maintenance (block 714). The sensor(s) will also be removed from the well when the pumping rod string is removed, providing an opportunity for the sensor(s) to be inexpensively inspected, maintained, and/or replaced.

While the foregoing is directed to embodiments of the present invention, other and further embodiments of the invention may be devised without departing from the basic scope thereof, and the scope thereof is determined by the claims that follow.

The invention claimed is:

1. A method for operating a well, comprising:

attaching a sensor to a cable and a pumping rod string, wherein the pumping rod string is configured to operate a down hole pump;

inserting the distal end of the pumping rod string and the attached sensor into the well, wherein the pumping rod string extends to a surface of the well, and wherein the cable extends to at least proximate the surface of the well along an exterior surface of the pumping rod string;

operating the down hole pump using the pumping rod string;

sensing at least one parameter of the well from the sensor; and transmitting the at least one sensed parameter from the sensor to the surface of the well.

2. The method of claim 1, wherein attaching the sensor to the pumping rod string comprises attaching the sensor to a cable and attaching the cable to the pumping rod string, and wherein the sensor transmits the at least one sensed parameter along the cable.

3. The method of claim 1, wherein attaching the sensor to the pumping rod string comprises clamping the sensor around the pumping rod string, and wherein the sensor transmits the at least one sensed parameter along the pumping rod string.

4. The method of claim 1, wherein inserting the pumping rod string with attached sensor into the well comprises inserting the pumping rod string and attached sensor into a casing and a production tubing in the well.

5. The method of claim 1, further comprising stopping operation of the down hole pump; and removing the pumping rod string and attached sensor from the well.

6. The method of claim 5, further comprising performing maintenance on at least one of the removed pumping rod string and sensor; and inserting the maintained pumping rod string and sensor into the well.

7. The method of claim 6, wherein performing maintenance on at least one of the removed pumping rod string and sensor comprises replacing the sensor.

8. The method of claim 1, wherein transmitting the at least one sensed parameter from the sensor to the surface of the well comprises acoustically transmitting the sensed parameters along the pumping rod string.

9. The method of claim 1, wherein attaching the sensor to the pumping rod string comprises attaching a first sensor and a second sensor to the pumping rod string, wherein the first sensor senses and transmits first parameters of the well and the second sensor senses and transmits second parameters of the well, wherein the first sensor is attached to the pumping rod string at a first position, wherein the second sensor is attached to the pumping rod string at a second position, and wherein the first position is closer to the distal end of the pumping rod string than the second position; and wherein transmitting the sensed parameters from the sensor to the surface of the well comprises:

the first sensor transmitting the sensed first parameters to the second sensor; and the second sensor receiving the sensed first parameters from the first sensor and transmitting the sensed first parameters and the sensed second parameters toward the surface.

10. An apparatus for measuring parameters in a well bore, wherein the well bore includes a pumping rod string driving a down hole pump, the apparatus comprising:

a low profile sensor configured to fit in an annulus between the pumping rod string and one of production tubing and casing, wherein the low profile sensor includes a transmitter for transmitting sensed data to the well surface;

a cable attached to the sensor and to the pumping rod string, and wherein the transmitter transmits the sensed data via the cable; and wherein the pumping rod string rotates in the well, further comprising a connector ring that includes a rotating ring attached to the pumping rod string and a stationary ring attached to the one of production tubing and casing, and wherein the connector ring passes the transmitted sensed data from the cable to a receiver at the surface of the well.

11. An apparatus for measuring parameters in a well bore, wherein the well bore includes a pumping rod string driving a down hole pump, the apparatus comprising:

a low profile sensor configured to fit in an annulus between the pumping rod string and one of production tubing and casing, wherein the low profile sensor includes a transmitter for transmitting sensed data to the well surface;

a cable attached to the sensor and to the pumping rod string, wherein the transmitter transmits the sensed data via the cable, wherein the pumping rod string reciprocates up and down; and further comprising a hollow rod portion arranged at a wellhead end of the pumping rod string, wherein the cable is disposed along an exterior portion of the pumping rod string and extends into an aperture formed in the pumping rod string such that the cable passes through the hollow rod portion.

12. An apparatus for measuring parameters in a well bore, wherein the well bore includes a pumping rod string driving a down hole pump, the apparatus comprising:

a low profile sensor configured to surround and attach to the pumping rod string, wherein the sensor fits in an annulus between the pumping rod string and one of production tubing and casing, wherein the sensor comprises a transmitter for transmitting sensed data to the well surface; and a cable attached to the sensor and disposed adjacent an exterior portion of the pumping rod string, wherein the pumping rod string extends to the well surface, and wherein the cable extends to at least proximate the well surface along the pumping rod string.

13. The apparatus of claim 12, wherein the transmitter comprises an electrode configured to contact the pumping rod string and to transmit the sensed data to the well surface via the pumping rod string.

14. The apparatus of claim 12, wherein the sensor further comprises an electrode configured to contact the pumping rod string and to receive electrical power transmitted from the well surface via the pumping rod string.

15. The apparatus of claim 12, wherein the transmitter comprises an acoustic transducer configured to transmit the sensed data in an acoustic waveform along the pumping rod string.

16. The apparatus of claim 15, wherein the sensor comprises an on-board power source configured to provide power to the sensor.

17. The apparatus of claim 12, wherein the low profile sensor comprises a first sensor, and wherein the transmitter of the first sensor transmits first sensed data to the well surface;

wherein the apparatus comprises a second low profile sensor configured to surround and attach to the pumping rod string, wherein the second sensor fits in the annulus, and wherein the second sensor comprises a transmitter configured to transmit second sensed data to the well surface;

wherein the first sensor is positioned on the pumping rod string at a different location than the second sensor; and wherein the first sensor transmits the first sensed data to the second sensor, and wherein the second sensor receives the first senses data from the first sensor and transmits the first sensed data and the second sensed data to the well surface.

* * * * *